US006361676B1

(12) United States Patent
Horie et al.

(10) Patent No.: US 6,361,676 B1
(45) Date of Patent: Mar. 26, 2002

(54) TECHNIQUE FOR MANUFACTURING ELECTRONIC PARTS

(75) Inventors: Shigeyuki Horie; Takao Hosokawa, both of Fukui-ken (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/434,163

(22) Filed: Nov. 4, 1999

(30) Foreign Application Priority Data

Nov. 30, 1998 (JP) ..... 10-339766

(51) Int. Cl.[7] ..... C25D 17/16
(52) U.S. Cl. ..... 205/143
(58) Field of Search ..... 205/143; 204/201, 204/213

(56) References Cited

U.S. PATENT DOCUMENTS 3,533,928 A 10/1970 Inoue ..... 204/43
3,776,827 A 12/1973 Inoue ..... 204/129.46
4,822,468 A 4/1989 Kanehiro ..... 204/213

FOREIGN PATENT DOCUMENTS

JP 2-228478 9/1990

OTHER PUBLICATIONS

Austrian Patent Office Search Report No. 9905337–3 Sep. 22, 2000.

*Primary Examiner*—Edna Wong
(74) *Attorney, Agent, or Firm*—Burns, Doane, Swecker & Mathis, LLP

(57) ABSTRACT

A technique for manufacturing electronic parts uses barrel plating to plate films on external electrodes of the electronic parts with small thickness variation of the plated films. The technique comprises disposing a plurality of non-spherical conductive elements in a plating barrel, disposing a plurality of electronic parts in the plating barrel, and rotating the plating barrel to form the plated films on the external electrodes of the electronic parts.

11 Claims, 4 Drawing Sheets

TECHNIQUE FOR MANUFACTURING ELECTRONIC PARTS

This application corresponds to Japanese Patent Application No. 10-339766, filed on Nov. 30, 1998, which is hereby incorporated by reference in its entirety.

BACKGROUND OF THE INVENTION

1. Field of the Invention

The present invention relates to a technique for manufacturing electronic parts in which a plated film is formed on an external electrode of an electronic part, such as, for example, a monolithic capacitor or the like, to form an external electrode. More particularly, the present invention relates to a technique for manufacturing an electronic part by barrel plating using a barrel into which conductive elements are mixed with electronic parts.

2. Description of the Related Art

In a chip type electronic part, such as, for example, a monolithic capacitor or the like, the surface of an external electrode of the electronic part comprises a plated film. The film has excellent solderability, which facilitates the mounting of the electronic part. In forming such a plated film, barrel plating has been frequently used.

The barrel plating technique uses a hexagonal cylindrical barrel 51 as shown in the cross-sectional view in FIG. 4(*a*). The barrel plating technique is performed by the following process. Chip type electronic parts to be plated are disposed in the barrel 51 together with numerous conductive elements. The barrel 51 is rotated. Electric conduction is affected between a negative pole bar 60 introduced in the barrel 51 and a positive pole of metal disposed in plating liquid outside of the barrel 51 (not shown). The ionized metal fused from the positive pole of the metal attaches to surfaces of the electrodes of the electronic parts that are charged with a negative electric potential by the negative pole bar 60 and the conductive elements. In this manner, the plating layer is formed. The conductive elements 51 collectively function as an electric medium which distributes the negative electric potential from the negative pole bar 60 uniformly over all the chip type electronic parts dispersed in the barrel 51.

More specifically, electronic parts (not shown) having external electrodes to be plated and numerous spherical conductive elements 52 are placed in the barrel 51, and electroplating is carried out in the barrel 51 while the barrel is rotated around the axis thereof in the direction of arrow A shown in FIGS. 4(*a*) and 4(*b*). The spherical conductive elements 52 function as electrodes for applying a voltage to the external electrodes, and also function as agitators which agitate the electronic parts in the barrel 51. That is, the rotation of the barrel 51 causes agitation of the conductive elements 52 and the electronic parts during electroplating, thereby permitting the formation of plated films having a uniform thickness on the external electrodes of the electronic parts.

Using conductive elements 52 that are spherical may beneficially decrease variations in thickness of the plated films on the external electrodes of many electronic parts placed in the barrel 51. This effect is promoted by the reduced variations in shape and dimensions of the conductive elements 52.

However, a problem occurs when the barrel 51 is rotated in the direction of arrow A, causing the conductive elements 52 to slide on the inner wall surface of the barrel 51. The conductive elements 52 and the electronic parts cannot be sufficiently agitated. More specifically, as shown in FIG. 4(*b*), when the barrel 51 is rotated in the direction of arrow A, many conductive elements 52 and the electronic parts (not shown) situated on the side 51*a* of the barrel 51 tend to move downward when the side 51*a* moves upward. In this case, because the conductive elements 52 have a spherical shape, when the barrel 51 is rotated in the direction A such that the side 51*b* moves into the position of side 51*a*, the conductive elements 52 and the electronic parts tend to slide down the side 51*a*, as shown by arrow B, and then move to the next side 51*b* without producing much agitation movement. Therefore, the conductive elements 52 and the electronic parts are not sufficiently agitated.

An increase in the diameter of the conductive elements 52 sometimes causes insufficient contact between the electronic parts and the conductive elements 52. More specifically, the conductive elements 52 have diameters which are not very large, as shown in FIG. 5. As such, the spaces between adjacent conductive elements 52 are small, thereby causing secure contact between the external electrodes 53 of the electronic parts and the conductive elements 52. On the other hand, with conductive elements having excessively large diameters, as shown in FIG. 6, the spaces C between adjacent conductive elements 52 are increased, decreasing the probability of contact between the external electrodes 53 of the electronic parts situated in the spaces C and the conductive elements 52. Therefore, it is necessary to prepare conductive elements 52 which have an appropriate diameter relative to the size of the electronic parts which are to be plated.

Thus, the above-described conventional method of manufacturing electronic parts using barrel plating can produce variations in thickness of the formed plated films due to sliding of the conductive elements 52 and parts on the side 51*a* of the barrel 51, the small size of electronic parts relative to the conductive elements 52, etc. These factors can cause variations in solderability and consequent soldering defects.

SUMMARY OF THE INVENTION

Accordingly, it is an object of the present invention to provide a method of manufacturing electronic parts including a plating technique capable of solving the problems of the above-described conventional technique. Namely, it is an object of the present invention to provide plated films having reduced thickness variations formed on external electrodes of electronic parts of various sizes.

In order to achieve the object of the present invention, a method of manufacturing electronic parts is provided, comprising disposing a plurality of deformed (e.g, non-spherical) conductive elements in a plating barrel, disposing a plurality of electronic parts in the plating barrel, and rotating the plating barrel to form a plated film on the external electrodes of the electronic parts.

The maximum dimension of a conductive element is defined as the length of the longest line segment which passes through a central region of the conductive element. The minimum dimension of a conductive element is defined as the length of the shortest line segment which passes through the central region of the conductive element. The deformed conductive elements preferably have a ratio of the maximum dimension to the minimum dimension within the range of about 1.1 to 3.0.

Further, in the present invention, the deformed conductive elements can be used in combination with spherical conductive elements.

The present invention also pertains to a combination comprising a barrel for use in plating a film on external electrodes of the electronic parts, and a plurality of non-spherical conductive elements disposed in the barrel for applying electric voltage to the electronic parts.

BRIEF DESCRIPTION OF THE DRAWINGS

The foregoing and other, objects, features and advantages of the present invention will be more readily understood upon reading the following detailed description in conjunction with the drawings in which.

DESCRIPTION OF THE PREFERRED EMBODIMENT

A method of manufacturing an electronic part in accordance with an exemplary embodiment of the present invention will be described with reference to FIGS. 1(*a*) and 1(*b*). This embodiment uses a hexagonal cylindrical barrel 1, although barrels with more or fewer sides can be used (e.g., generally, a polygonally shaped barrel is used). Many conductive elements 2 and 3 are disposed in the barrel 1. The conductive elements 2 have a deformed shape, i.e., not a spherical shape, and the conductive elements 3 have a spherical shape. That is, this embodiment uses the deformed non-spherical conductive elements 2 in combination with the spherical conductive elements 3. Electric voltage is applied to the conductive elements and the parts in a conventional manner, e.g., in the manner described in the background section of the present specification.

The ratio of the deformed conductive elements 2 is preferably 10 to 100% by weight relative to the spherical conductive elements 3. Using deformed conductive elements 2 at a ratio of less than 10% by weight may not produce the desired effect (to be described below), potentially causing variations in thickness of plated films, as in the conventional technique.

Appropriate conductive materials can be used for forming the conductive elements 2 and 3, as in the case of the conventional conductive elements. Appropriate exemplary materials includes iron, chromium, carbon, and the like.

The maximum dimension of a conductive element is defined as the length of the longest line segment which passes through a central region of the conductive element. The minimum dimension of a conductive element is defined as the length of the shortest line segment which passes through the central region of the conductive element. These line segments are labeled as "X" and "Y" in FIGS. 2(*b*) and 2(*c*). The deformed conductive elements 2 can have a variety of non-spherical shapes having different maximum and minimum dimensions. More specifically, the deformed conductive elements preferably have a ratio of maximum to minimum dimensions in the range of about 1.1 to 3.0, and more preferably about 1.1 to 2.0. With a ratio of less than about 1.1, the element shape closely resembles a spherical shape, causing similar problems to those encountered with spherical shapes. With a ratio of over about 3.0, the elements are held in spaces (or "holes") formed in the barrel by the conductive elements, which impedes agitation of the elements.

Figure 2A:
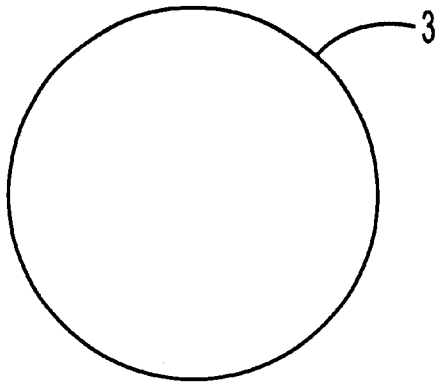
FIG. 2(*a*) is a front view showing a spherical conductive element, FIG. 2(*b*) is a front view showing a deformed conductive element, and FIG. 2(*c*) is a front view showing another example of a deformed conductive element.
Figure 2B:
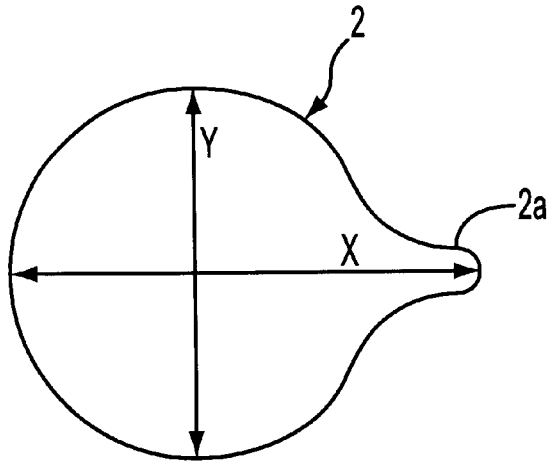
Figure 2C:
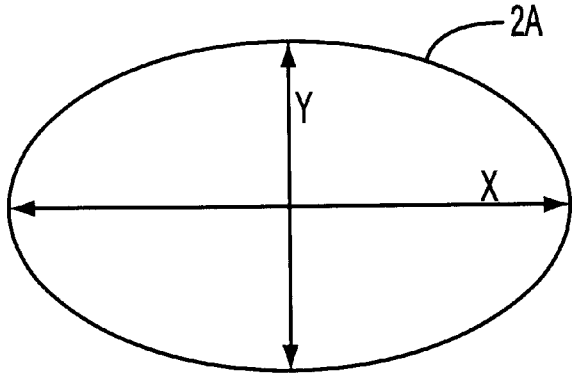

The maximum and minimum dimensions will be described with reference to FIGS. 2(*a*) to 2(*c*). FIG. 2(*a*) is a front view showing a spherical conductive element 3 in which all points on the surface of the element 3 are the same distance from its center, i.e., the maximum and minimum dimensions are the same. On the other hand, the deformed conductive element 2 shown in FIG. 2(*b*) has a shape in which a portion of a sphere projects out to form a projection 2*a*.

The deformed conductive element 2 is not limited to the shape shown in FIG. 2(*b*), e.g., in which a portion of a sphere projects out to form the projection 2*a*. For instance, an elliptical shape as shown in FIG. 2(*c*) can be used. In the elliptical conductive element 2A, the maximum dimension is labeled X and the minimum dimension is labeled Y.

Figure 3:
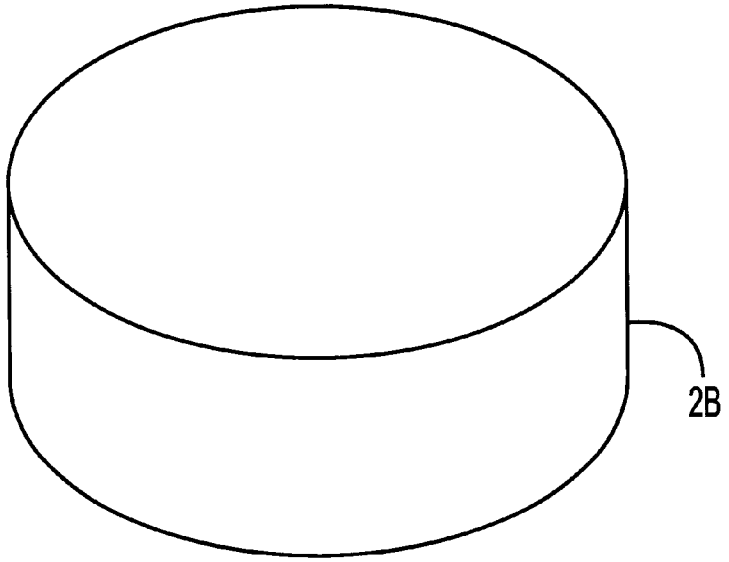
FIG. 3 is a perspective view showing another example of a deformed conductive elements which can be used in the present invention.
Figure 4A:
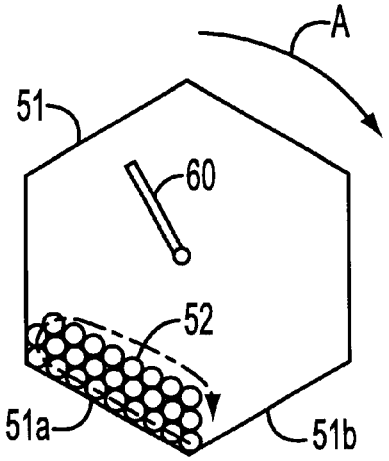
FIG. 4(*a*) and FIG. 4(*b*) are respective schematic cross-sectional views illustrating the problems encountered with the barrel plating operation in a conventional method of manufacturing electronic parts.
Figure 4B:
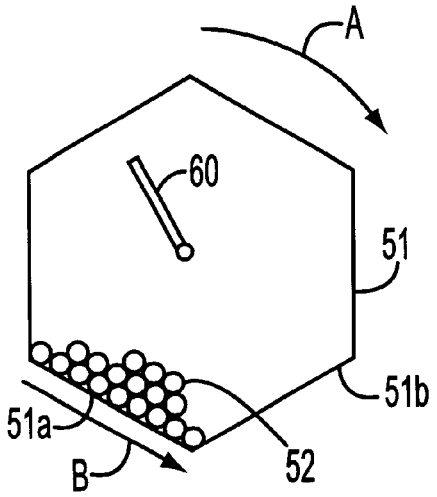
Figure 5:
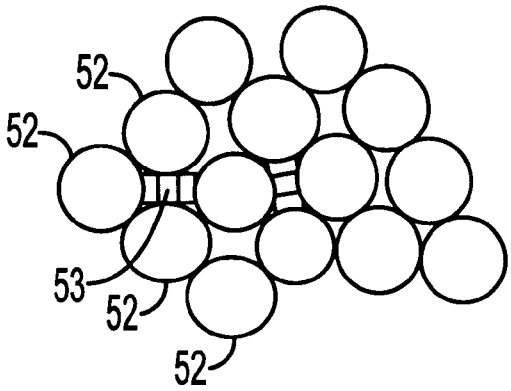
FIG. 5 is a schematic front view illustrating the state of contact between conductive elements and electronic parts in a conventional barrel plating method.
Figure 6:
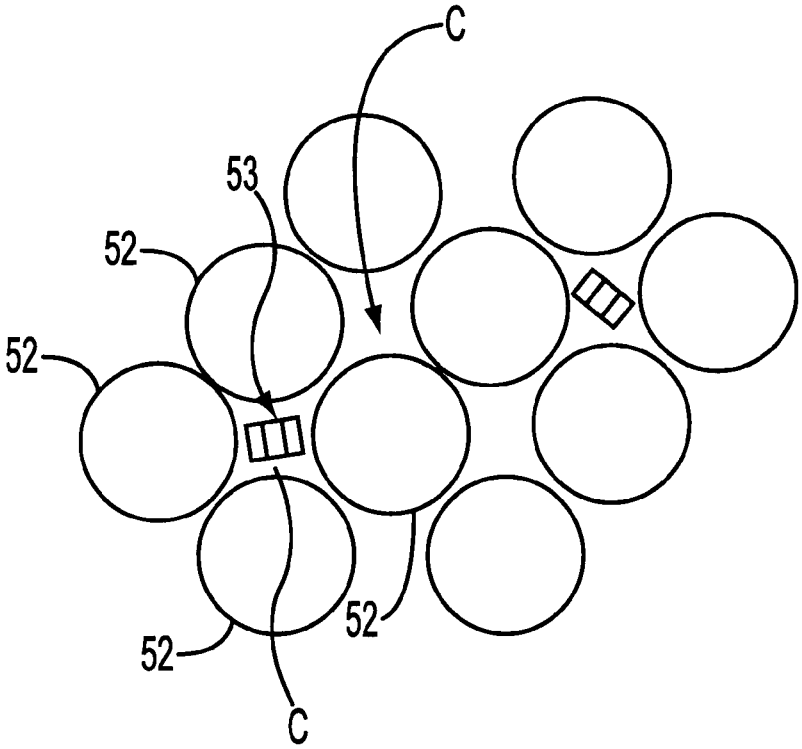
FIG. 6 is a schematic front view illustrating problems encountered due to poor contact between conductive elements and electronic parts in barrel plating in a conventional method of manufacturing electronic parts.

Further, as shown in perspective view of FIG. 3, disk-shaped conductive elements 2B can be used. In the disk-shaped conductive element 2B shown in FIG. 3, the diameter of the upper and lower sides constitutes the maximum dimension, and the height is the minimum dimension. Conductive elements having various other shapes, such as a cylindrical shape, a prismatic shape, a hexagonal plate, etc., can be used as deformed conductive elements.

Figure 1A:
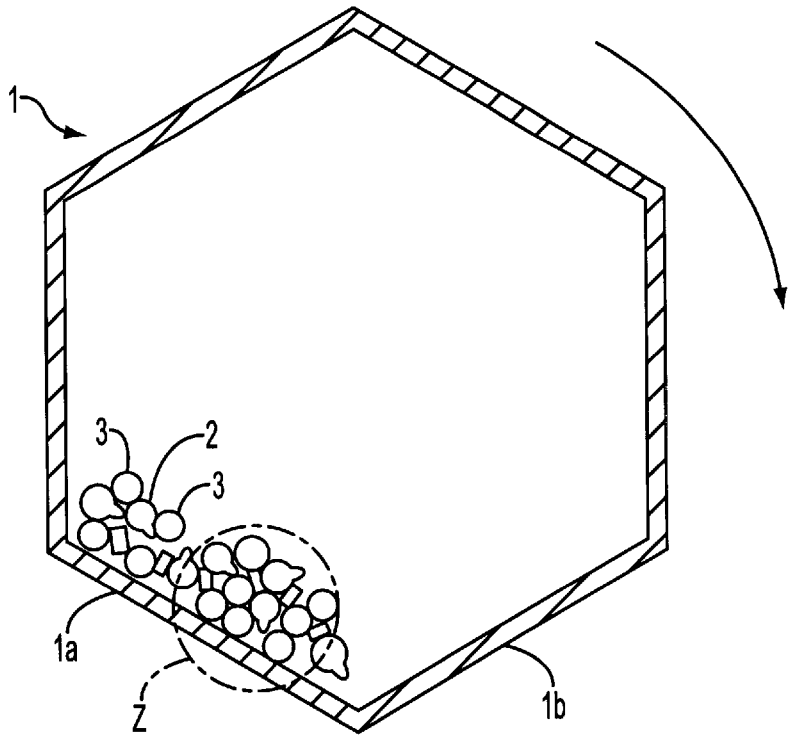
FIG. 1(*a*) and FIG. 1(*b*) illustrate the barrel plating step of a method of manufacturing electronic parts in accordance with an exemplary embodiment of the present invention, in which FIG. 1(*a*) is a cross-sectional view showing a barrel including parts in the state of being agitated, and FIG. 1(*b*) is an enlarged view of a portion Z of the barrel shown by a one-dot chain line in FIG. 1(*a*)
Figure 1B:
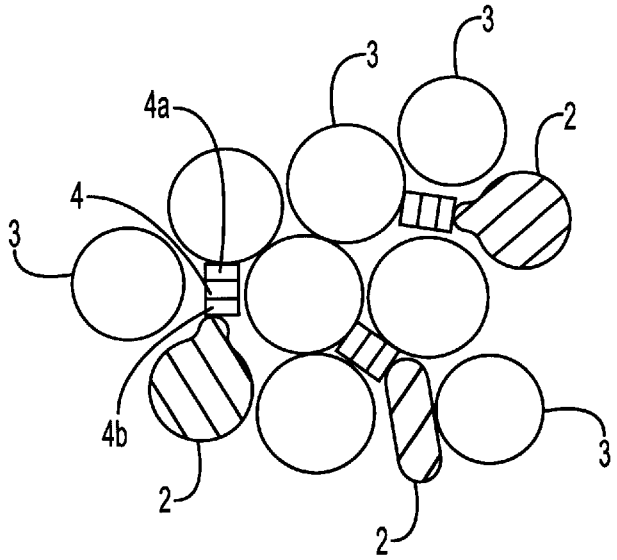

Referring to FIG. 1, in this embodiment, many electronic parts 4 are placed in the barrel 1 together with the conductive elements 2 and 3. The electronic parts 4 have electrode films formed on their outer surfaces by coating and baking conductive paste onto their surfaces. Other types of parts can, of course, be used, such as parts in which electrode films are formed by some method other than coating and baking conductive paste. Plated films are formed in the barrel on the previously formed electrode films by barrel plating to complete the external electrodes, thereby obtaining finished electronic parts.

While a voltage is applied, the barrel 1 is rotated around its axis in the direction of arrow A to form plated films on electrode films 4*a* and 4*b* (refer to FIG. 1(*b*)) of the electronic parts 4. The conductive elements 2 and 3 and the electronic parts 4 positioned principally on side la are readily moved to the adjacent side 1*b* when the barrel 1 rotates. As previously discussed, in the above-described conventional example, the conductive elements 52 and the electronic parts 53 positioned on the side 51 slide down the side 51*a* to move to the next side 51*b* with rotation of the barrel 51. In contrast, in the present embodiment, the use of the deformed conductive elements 2 causes the deformed conductive elements 2 to slide to a lesser extent on the side 1*a*. At the same time, the elements 2 can easily rotate due to the influence of the projections 2*a*. Therefore, when the side la is moved in the direction of arrow A, the deformed conductive elements 2, the conductive elements 3 and the electronic parts 4 do not simply slide on the side 1*a*, but topple onto on the side 1*b* while being intermixed and agitated. Therefore, the conductive elements 2 and 3 and the electronic parts 4 are readily agitated and mixed in the barrel 1.

Furthermore, as shown in FIG. 1(*b*) (which is an enlarged view of a portion shown by a one-dot chain line Z in FIG. 1(*a*)), the spaces between the adjacent conductive elements are decreased. More specifically, since the projections 2*a* of the deformed conductive elements 2 enter the spaces between the adjacent conductive elements 2 and 3, the spaces between adjacent conductive elements decrease, thereby increasing the probability of contact between the electronic parts 4 and the conductive elements 2 and 3.

As a result, plated films can be formed with a more uniform thickness on the electrode films of the electronic parts 4 due to: (1) the improved agitation of the conductive elements 2 and 3 and the electronic parts 4 in the barrel 1, and (2) the improved contact formed between the electronic parts and the conductive elements due to the reduced spaces between adjacent conductive elements.

The types of electronic parts used in the present invention are not restricted to those described above. However, it is preferable that the electronic parts be of the type having plated films formed on electrode films, which, in turn, are formed on the outer surfaces of the electronic parts to form external electrodes. For example, the present invention can be applied to various ceramic electronic parts, such as monolithic capacitors, single-chip ceramic capacitors, piezoelectric ceramic parts, and the like. The present invention is also applicable to electronic parts in which electrode films and plated films are formed on outer surfaces of non-ceramic electronic parts or devices to form external electrodes.

Experimental examples will be described below.

Conductive elements 2 having the projections 2*a* shown in FIG. 2(*b*) were prepared. The prepared conductive elements 2 had a maximum dimension X of 1.0 to 1.5 mm, and a minimum dimension Y of 0.8 to 1.2 mm. Conductive elements 3 having a diameter of 1 mm were also prepared. The deformed conductive elements 2 and the spherical conductive elements 3 were mixed at various ratios shown in Table 1 below to prepare conductive elements of Sample Nos. 1 to 11.

Monolithic ceramic capacitors having dimensions of 1.6 mm×0.8 mm×0.8 mm were prepared. Electrode films were previously formed on the monolithic ceramic capacitors by coating and baking silver (Ag) paste to cover opposite end surfaces of the ceramic sintered compacts.

10000 monolithic ceramic capacitors, and 1000 g of conductive elements of any one of Sample Nos. 1 to 11 were put in the hexagonal cylindrical barrel 1. The barrel 1 was then rotated at a rotational of 1 rpm. Nickel (Ni) plated films were formed with a supplied current of 20A, and then Tin (Sn) plated films were formed with a supplied current of 15A. Although the rotational speed of the barrel 1 is generally about 5 to 20 rpm, in the experimental examples, the rotational speed was 1 rpm in order to accelerate sliding of the conductive elements. A Watts plating bath and a carboxylic acid Sn bath were used for the Ni plating and Sn plating, respectively.

As described above, Ni plated films and Sn plated films were formed, in turn, by using the conductive elements of each of Sample Nos. 1 to 11. Table 1 shows the average thicknesses and thickness variations CV of the plated films formed by using the conductive elements of each of Sample. The variation CV (%) is a value represented by (standard deviation/thickness average of plated film X)×100.

TABLE 1

| Sample | Mixing ratio (wt %) | | Ni plated film | | Sn plated film | |
|---|---|---|---|---|---|---|
| No. | Spherical | Deformed | X (mm) | CV (%) | X (mm) | CV (%) |
| 1 | 100 | 0 | 1.2 | 24 | 2.1 | 18 |
| 2 | 90 | 10 | 2.2 | 11 | 4.0 | 10 |
| 3 | 80 | 20 | 2.3 | 10 | 4.2 | 8 |
| 4 | 70 | 30 | 2.3 | 8 | 4.1 | 7 |
| 5 | 60 | 40 | 2.5 | 9 | 4.2 | 8 |
| 6 | 50 | 50 | 2.7 | 9 | 4.5 | 8 |
| 7 | 40 | 60 | 2.4 | 10 | 3.9 | 10 |
| 8 | 30 | 70 | 2.5 | 9 | 4.1 | 8 |
| 9 | 20 | 80 | 2.5 | 8 | 4.3 | 9 |
| 10 | 10 | 90 | 2.4 | 9 | 4.0 | 9 |
| 11 | 0 | 100 | 2.3 | 10 | 4.2 | 8 |

Table 1 indicates that, in Sample No. 1, using only the spherical conductive elements, the average thickness of the Ni plated films is as small as 1.2 mm, and the average thickness of the Sn plated films is as small as 2.1 mm. The thickness variations CV for Sample No. 1 of the Ni plated films and the Sn plated films are as high as 24% and 18%, respectively. This is possibly due to the fact that the spherical conductive elements slide on the sides of the barrel 1, and thus the conductive elements and the monolithic ceramic capacitors are not sufficiently agitated and mixed.

On the other hand, use of the conductive elements of Samples Nos. 2 to 11 permits increases in thickness of the Ni plated films and the Sn plated films and significant decreases in thickness variations of the plated films. This is possibly due to the fact that the deformed conductive elements cause sufficient agitation of the conductive elements and the monolithic ceramic capacitors.

Next, in the second experiment, the rotation speed of the barrel 1 was set to 10 rpm, and two types of conductive elements respectively having diameters of 1 mm and 2 mm were used. In this case, the mixing ratios of the spherical conductive elements and deformed conductive elements were the same as Sample Nos. 1 to 11 to prepare conductive elements for each of Sample Nos. 21 to 31. As shown in Table 2 below, in Sample Nos. 21 to 31, conductive elements having diameters of 1 mm or 2 mm were used as the spherical conductive elements. Namely, in Sample No. 11 as an example, plating was carried out under two conditions in which the spherical conductive elements having a diameter of 1 mm were used, and in which the spherical conductive elements having a diameter of 2 mm were used. The other conditions were set the same as the first experiment to form Ni plated films and Sn plated films on the outer surfaces of the electronic parts. The results are shown in Table 2.

TABLE 2

| Sample No. | Diameter Mixing ratio (wt %) Spherical | De-formed | 1 mm Ni plated film X (mm) | CV (%) | 1 mm Sn plated film X (mm) | CV (%) | 2 mm Ni plated film X (mm) | CV (%) | 2 mm Sn plated film X (mm) | CV (%) |
|---|---|---|---|---|---|---|---|---|---|---|
| 21 | 100 | 0 | 2.4 | 15 | 4.0 | 12 | 0.9 | 35 | 1.7 | 28 |
| 22 | 90 | 10 | 2.6 | 8 | 4.7 | 7 | 2.1 | 11 | 4.1 | 11 |
| 23 | 80 | 20 | 2.8 | 7 | 4.5 | 8 | 2.1 | 10 | 4.0 | 10 |
| 24 | 70 | 30 | 2.7 | 6 | 4.6 | 7 | 2.3 | 8 | 4.2 | 9 |
| 25 | 60 | 40 | 2.9 | 7 | 4.7 | 7 | 2.5 | 8 | 4.3 | 9 |
| 26 | 50 | 50 | 3.1 | 7 | 4.8 | 8 | 2.4 | 9 | 4.2 | 9 |
| 27 | 40 | 60 | 2.9 | 9 | 4.5 | 9 | 2.4 | 8 | 4.3 | 10 |
| 28 | 30 | 70 | 2.6 | 8 | 4.4 | 9 | 2.6 | 7 | 4.5 | 9 |
| 29 | 20 | 80 | 2.8 | 7 | 4.6 | 8 | 2.7 | 9 | 4.6 | 8 |
| 30 | 10 | 90 | 2.7 | 8 | 4.8 | 8 | 2.6 | 8 | 4.6 | 9 |
| 31 | 0 | 100 | 2.9 | 7 | 4.5 | 9 | 2.7 | 8 | 4.5 | 7 |

As seen from Table 2, Sample No. 21 uses only spherical conductive elements. conductive elements having a diameter of 1 mm were used, the Ni plated films plated films formed by using the conductive elements of Sample No. 21 have thicknesses with larger thickness variations CV than the Ni plated films and Sn plated films formed by using the conductive elements of Sample Nos. 22 to 31. However, the differences in thickness are smaller than the first experimental example. This is because the rotational speed of the barrel 1 is 10 rpm. On the other hand, in No. 21, the thicknesses of the Ni plated films and Sn plated films are significantly decreased by changing the diameter of the spherical conductive elements from 1 mm to 2 mm, and the variations (CV) are also significantly increased. This is possibly due to the fact that the spaces between the adjacent spherical conductive elements are increased by increasing the diameter of the spherical conductive elements, which, in turn, decreases the probability of contact between the external electrodes of the monolithic ceramic capacitors having the above dimensions and the conductive elements.

On the other hand, by using the conductive elements of Sample Nos. 22 to 31, decreases in thickness of the Ni plated films and Sn plated films, and the thickness variations (CV) thereof vary slightly, while the thicknesses of the plated films are significantly increased, and the thickness variations are significantly decreased, as compared with Sample No. 21. It can also be observed that as the ratio of the deformed conductive elements mixed increases, the thickness of the plated films increases, and the variation (CV) decreases. This is possibly due to the fact that the spaces between the adjacent conductive elements are decreased due to the presence of the deformed conductive elements, thereby increasing the probability of contact between the monolithic ceramic capacitors and the conductive elements.

It is thus found that, in Sample Nos. 22 to 30, even when the diameter of the spherical conductive elements is changed to 2 mm, the thickness of the plated films is decreased to a lesser extent, and the variation CV is increased to a lesser extent.

In summary, in the method of manufacturing an electronic part of the present invention, a plurality of electronic parts and conductive elements including deformed conductive elements, which are non-spherical, are put in a barrel for barrel plating. Therefore, when the barrel is rotated during plating, the deformed conductive elements slide to a lesser extent on the sides of the barrel, and thus the electronic parts and the conductive elements are more readily agitated and mixed. In addition, the spaces between adjacent conductive elements are decreased to increase the probability of contact between the conductive elements and electrode films of the electronic parts. Therefore, barrel plated films can more reliably be formed on the electrode films formed on the outer surfaces of the electronic parts, and the thickness variations of the plated films in a lot can be significantly decreased. It is thus possible to provide electronic parts having excellent reliability, which causes fewer soldering defects, for example, in solder-mounting the parts on a printed circuit board.

In the present invention, when the ratio of the maximum dimension to the minimum dimension of the deformed conductive elements is in the range of about 1.1 to 3.0, the agitation of the electronic parts and conductive elements by using the deformed conductive elements is readily increased. Further, the spaces between adjacent conductive elements decreases to more effectively increase the probability of contact between the electronic parts and the conductive elements.

In one embodiment, only the deformed conductive elements are used. Alternatively, the deformed conductive elements can be combined with spherical conductive elements. In this later case, the thickness variations of plated films can be effectively decreased due to the presence of the deformed conductive elements.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A method of manufacturing electronic parts having an external electrode formed on the outer surface thereof, the method comprising:

disposing a plurality of freely movable non-spherical conductive elements in a plating barrel;

disposing a plurality of electronic parts in the plating barrel, the electronic parts not being the non-spherical conductive elements;

rotating the plating barrel; and applying a voltage through the electronic parts to form a plated film on the external electrodes of the electronic parts.

2. A method of manufacturing electronic parts according to claim 1, wherein the conductive elements each have a maximum dimension defined as the length of a longest line segment which passes through a central region of each of the conductive elements, and each of the conductive elements have a minimum dimension defined as the length of a shortest line segment which passes through the central region of each of the conductive elements, wherein the ratio of the maximum dimension to the minimum dimension of each of the non-spherical conductive elements is in the range of about 1.1 to 3.0.

3. A method of manufacturing electronic parts according to claim 2, wherein the ratio of the maximum dimension to the minimum dimension of the non-spherical conductive elements is in the range of about 1.1 to 2.0.

4. A method of manufacturing electronic parts according to claim 1, further including the step of disposing spherical conductive elements in the plating barrel.

5. A method of manufacturing electronic parts according to claim 4, wherein the ratio of the non-spherical conductive elements to the spherical conductive elements is about 10% or greater by weight.

6. A method of manufacturing electronic parts according to claim 1, wherein the non-spherical elements include at least one protrusion extending from an outer surface of the non-spherical elements.

7. A method of manufacturing electronic parts according to claim 6, wherein the non-spherical elements have a generally spherical shape except for the protrusion.

8. A method of manufacturing electronic parts according to claim 1, wherein the non-spherical elements have a disk shape.

9. A method of manufacturing electronic parts according to claim 1, wherein an inner surface of said barrel has a polygonal shape.

10. A method of manufacturing electronic parts according to claim 1, wherein an inner surface of said barrel has a hexagonal shape.

11. A method of manufacturing electronic parts according to claim 1, wherein said step of disposing a plurality of conductive elements in a plating barrel comprises disposing the plurality of conductive elements in a plating barrel containing an electroplating bath.

* * * * *